US007456717B2

(12) United States Patent
Grueso et al.

(10) Patent No.: US 7,456,717 B2
(45) Date of Patent: Nov. 25, 2008

(54) ELECTRICAL PIN-TYPE CONNECTOR

(75) Inventors: Alfredo Grueso, Rizal (PH); Nestor Estrada, Paranaque (PH)

(73) Assignee: Astec International Limited, Kwun Tong, Kowloon (HK)

( * ) Notice: Subject to any disclaimer, the term of this patent is extended or adjusted under 35 U.S.C. 154(b) by 0 days.

(21) Appl. No.: 11/701,701

(22) Filed: Feb. 2, 2007

(65) Prior Publication Data

US 2008/0188145 A1 Aug. 7, 2008

(51) Int. Cl.
*H01F 27/29* (2006.01)

(52) U.S. Cl. ..... 336/192; 439/709

(58) Field of Classification Search ..... 439/709; 336/192

See application file for complete search history.

(56) References Cited

U.S. PATENT DOCUMENTS

| | | | | |
|---|---|---|---|---|
| 3,633,914 | A * | 1/1972 | Solomon | 273/269 |
| 3,663,914 | A * | 5/1972 | Lane | 336/192 |
| 4,092,622 | A * | 5/1978 | Widemann et al. | 336/192 |
| 4,246,562 | A * | 1/1981 | Widemann et al. | 336/192 |
| 4,661,792 | A * | 4/1987 | Watkins | 336/65 |
| 4,888,571 | A * | 12/1989 | Kobayashi et al. | 336/65 |
| 5,008,644 | A * | 4/1991 | Cooper | 336/192 |
| 5,200,731 | A * | 4/1993 | Tochio et al. | 336/98 |
| 5,235,305 | A * | 8/1993 | Scheffler | 336/192 |
| 5,262,745 | A * | 11/1993 | Gutierrez | 336/192 |
| 5,281,942 | A * | 1/1994 | Stokes | 336/192 |
| 5,446,958 | A * | 9/1995 | Hoang | 29/605 |
| 5,694,105 | A * | 12/1997 | Weiner | 336/198 |
| 6,384,704 | B1 * | 5/2002 | Motomura | 336/192 |
| 6,466,121 | B1 * | 10/2002 | Moreno et al. | 336/198 |
| 6,480,085 | B2 * | 11/2002 | Chiang et al. | 336/198 |
| 6,483,412 | B1 * | 11/2002 | Holdahl et al. | 336/192 |
| 6,515,567 | B2 * | 2/2003 | Yeh et al. | 336/192 |
| 6,696,908 | B2 * | 2/2004 | Okano et al. | 336/198 |
| 6,755,692 | B2 * | 6/2004 | Hsu | 439/620.05 |
| 6,781,499 | B2 * | 8/2004 | Steiner | 336/192 |
| 7,135,950 | B2 * | 11/2006 | Chang et al. | 336/192 |
| 7,154,365 | B2 * | 12/2006 | Park | 336/198 |

* cited by examiner

*Primary Examiner*—Ross N Gushi
(74) *Attorney, Agent, or Firm*—Harness, Dickey & Pierce, P.L.C.

(57) ABSTRACT

In accordance with various embodiments of the present disclosure, an electrical connector is provided. The electrical connector includes an electrically conductive pin extending from a base of the connector. The electrical connector additionally includes a standoff extending from the base adjacent the pin and forming an acute angle with the pin.

28 Claims, 7 Drawing Sheets

ELECTRICAL PIN-TYPE CONNECTOR

FIELD

The present teachings relate generally to electrical connectors having an electrically conductive pin to which a wire of an electrical component is secured.

BACKGROUND

The statements in this section merely provide background information related to the present disclosure and may not constitute prior art.

Various electrical components and magnetic assemblies comprise wires or windings that must be terminated on electrically conductive pins. For example, the wires of power transformers used in cellular phone chargers, and other auxiliary transformers that employ thin wires, are typically terminated on pins of a connector. Particularly, the pins are typically retained by, or formed with, an electrically insulative connector such that the pins are connectable to a circuit board to provide electrical connection of wires with the circuit board. For example, one or more distal ends, or tips, of the pins can be inserted into circuit board vias and soldered in place to form an electrical connection between the pin and the circuit board, and thus, between the wires and the circuit board.

Generally, the pins are retained within a pin pocket of a connector base and extend beyond one or more sides of the connector base. Additionally, the base typically includes standoffs that extend along the length of each pin to protect the pins from damage. The standoffs are oriented parallel with, and just adjacent to, the pins, leaving a substantially consistent space between the pins and the standoffs. To terminate, or connect, the wires to the pins, the wires are typically wrapped around the pins several times, e.g., eight times, in order to hold each wire tightly on the respective pin. Solder is then typically applied to bond the wire to the pin.

The process of wrapping the wire around the pins several times is time consuming and requires certain lengths of wire, both of which increase the manufacturing cost.

SUMMARY

In accordance with various embodiments of the present disclosure, an electrical connector is provided. The electrical connector includes an electrically conductive pin extending from a base of the connector. The electrical connector additionally includes a standoff extending from the base adjacent the pin and forming an acute angle with the pin.

In accordance with various other embodiments of the present disclosure, an electrical connector is provided. The electrical connector includes a base that retains a first leg of an electrically conductive pin such that a second leg of the electrically conductive pin extends from the base. The connector additionally includes a standoff extending from the base adjacent the pin second leg and forming an acute angle with the second leg. The acute angle is sized to receive a wire at an open end of the acute angle, and pinch and retain the wire between the pin second leg and the standoff near a vertex of the acute angle that originates near the connector base.

In accordance with yet other embodiments of the present disclosure, a method for securing a wire of an electrical component to an electrical connector is provided. The electrical connector is connectable to a circuit board such that securing the wire to the connector can provide an electrical connection between the wire and the circuit board. The method includes inserting a wire into an open end of an acute angle formed between an electrically conductive pin extending from a base of the connector and a standoff extending from the base adjacent the electrically conductive pin. The acute angle has a vertex near the base. The wire can then be pushed toward the vertex of the acute angle such that the wire is pinched between the pin and the standoff near a vertex, thereby securing the wire to the connector.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
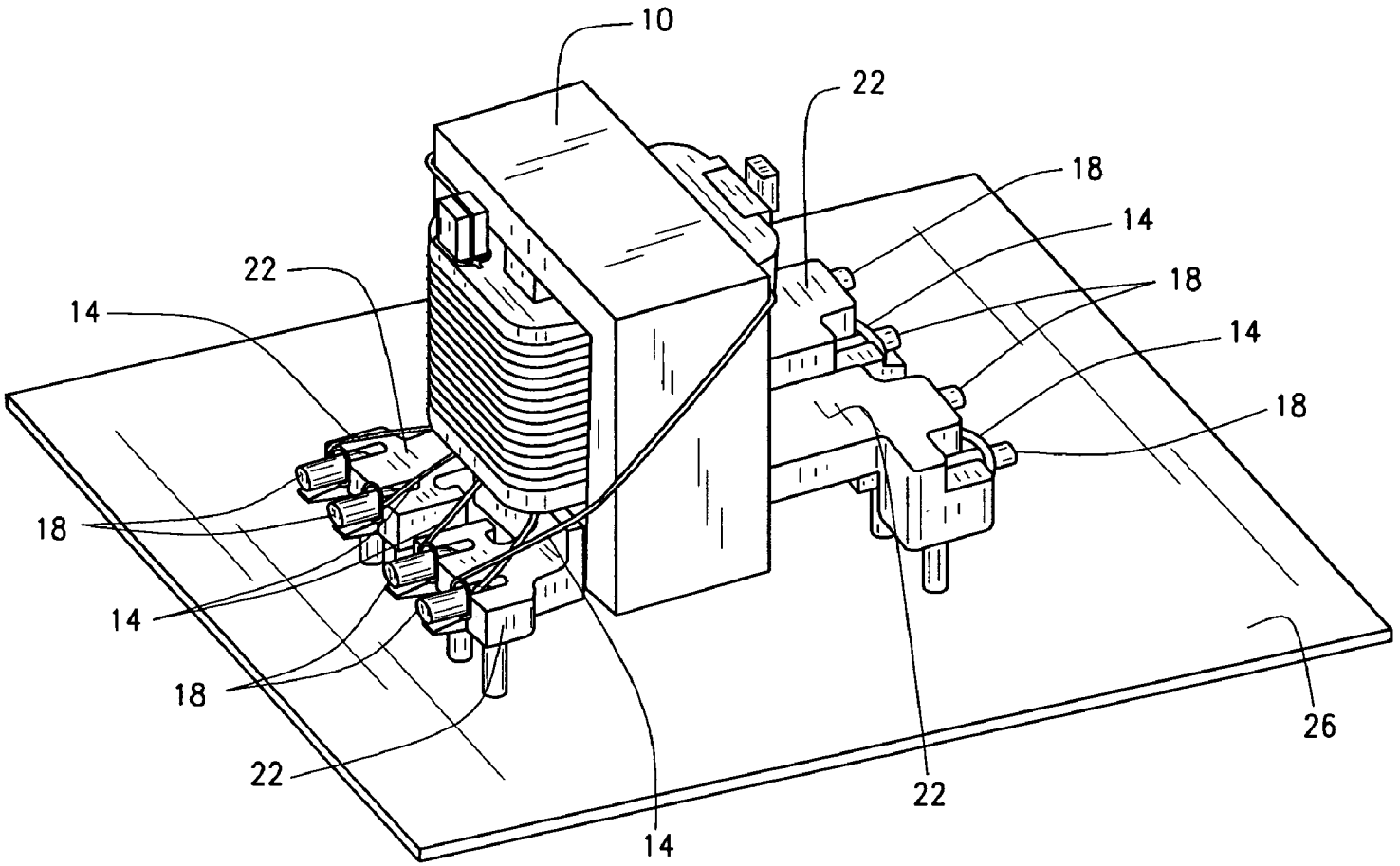
FIG. 1 is an isometric view of an electrical component having wires terminated to pins of a plurality of connectors mounted to a circuit board, in accordance with various embodiments of the present disclosure.

The following description is merely exemplary in nature and is in no way intended to limit the present teachings, applications, or uses. Throughout this specification, like reference numerals will be used to refer to like elements.

Referring to FIG. 1, an electrical component 10 having wires 14 terminated to electrically conductive pins 18 of a plurality of connectors 22 is illustrated, in accordance with various embodiments of the present disclosure. The component 10 can be any electrical component and/or magnetic assembly that includes wires or windings that must be terminated on electrically conductive pins. For example, in various embodiments, the component 10 can be a transformer such as a power transformers used in cellular phone chargers.

The connectors 22 are mountable to a circuit board 26 to electrically connect the component 10 to the circuit board 26. More particularly, the pins 18 can be connected to the circuit board 26 to mount the respective connectors 22 to the circuit board 26 and provide an electrical connection between the component 10 and circuit board 26. As described in detail below, the wires 14 are terminated and tightly held on the pins 18 by wrapping the wires 14 around the pins 18 at least a single time. Although FIG. 1 illustrates the component 10 having a plurality of wires 14 and the connectors 22 having a plurality of pins 18 to which the wires 14 are terminated, it should be understood that component 10 can have one or more wires 14 and the connectors 22 one or more pins 18, and remain within the scope of the present disclosure.

Figure 2:
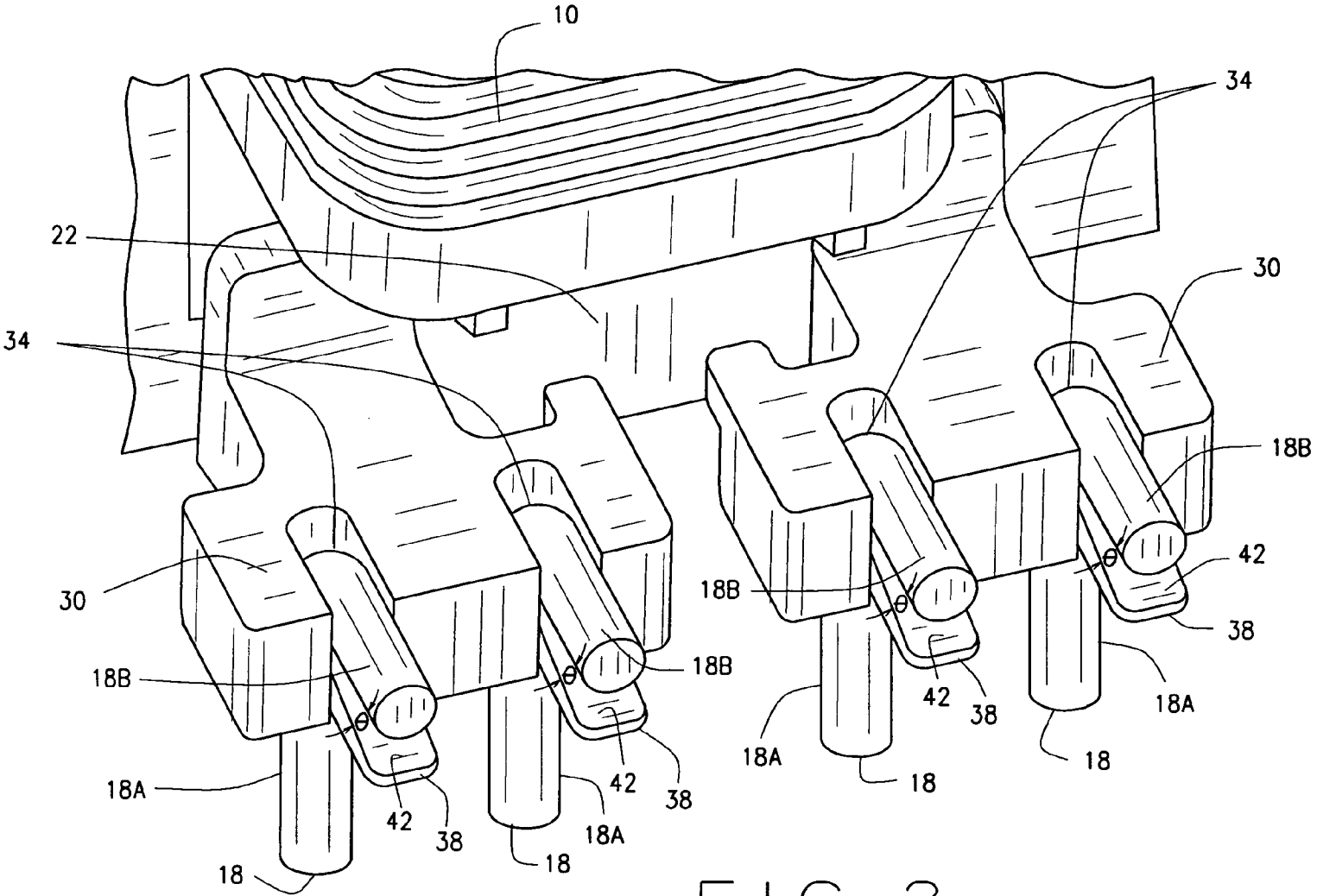
FIG. 2 is an isometric view of an exemplary connector shown in FIG. 1, in accordance with various embodiments of the present disclosure.
Figure 3:
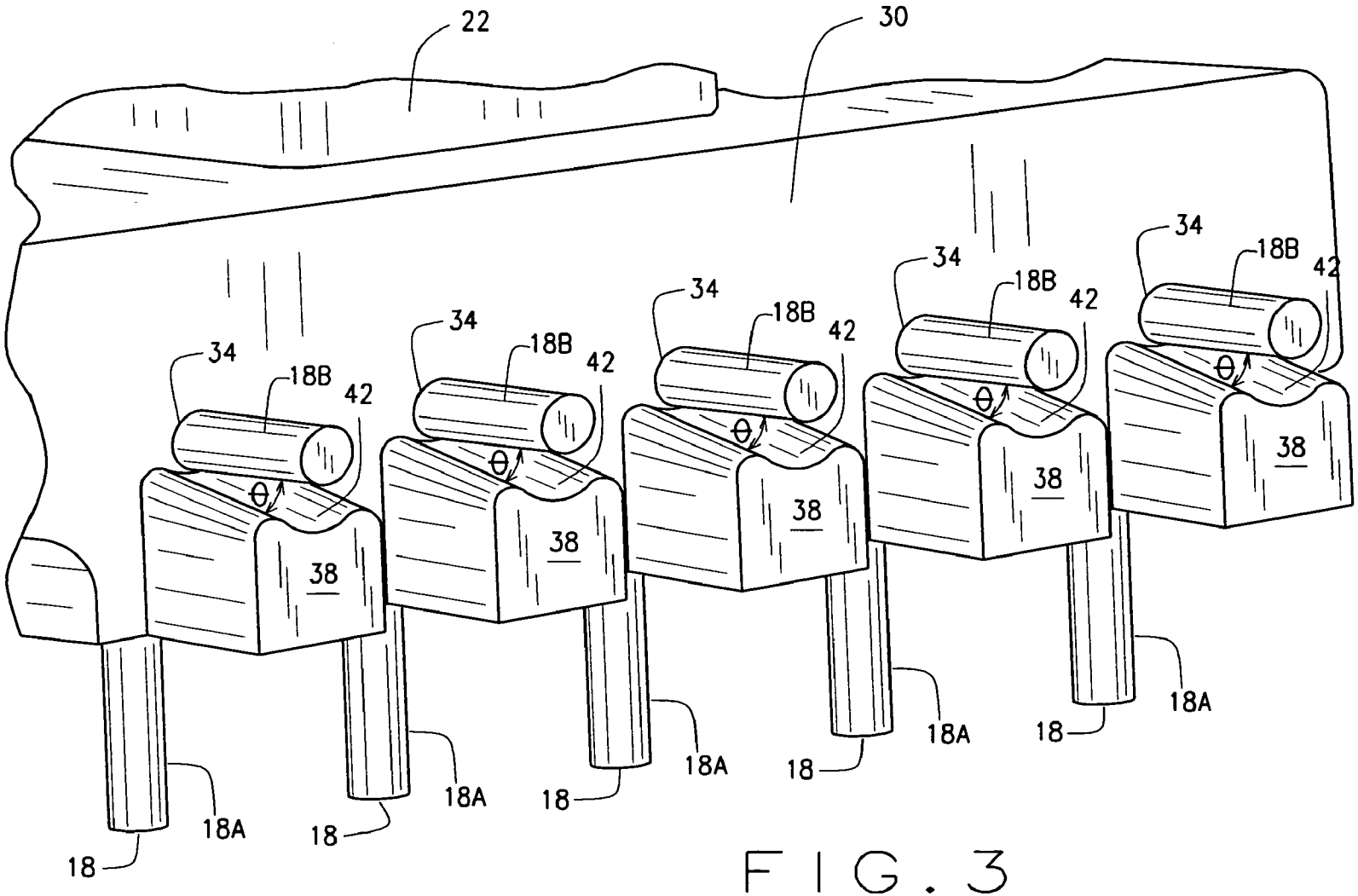
FIG. 3 is an isometric view of an exemplary connector shown in FIG. 1, in accordance with various other embodiments of the present disclosure.

Referring now to FIGS. 2 and 3, each connector 22 generally includes one or more base portions 30 that includes one or more pin pockets 34. Each pin pocket 34 receives and retains an electrically conductive pin 18. In various embodiments, the pin pockets 34 can be holes though which the pins 18 are force fit, while in other embodiments the pin 18 can be molded into the respective connector base 30 such that pin pockets 34 are formed around the pins 18. More particularly, each pin 18 includes a first leg 18A that is retained within the respective pin pocket 34, and a second leg 18B that extends, or protrudes, from the respective connector base 30. Each connector base 30 additionally includes a standoff 38 for each respective pin 18. Each standoff 38 extends from the base 30 adjacent to the second leg 18B of the respective pin 18.

Figure 4:
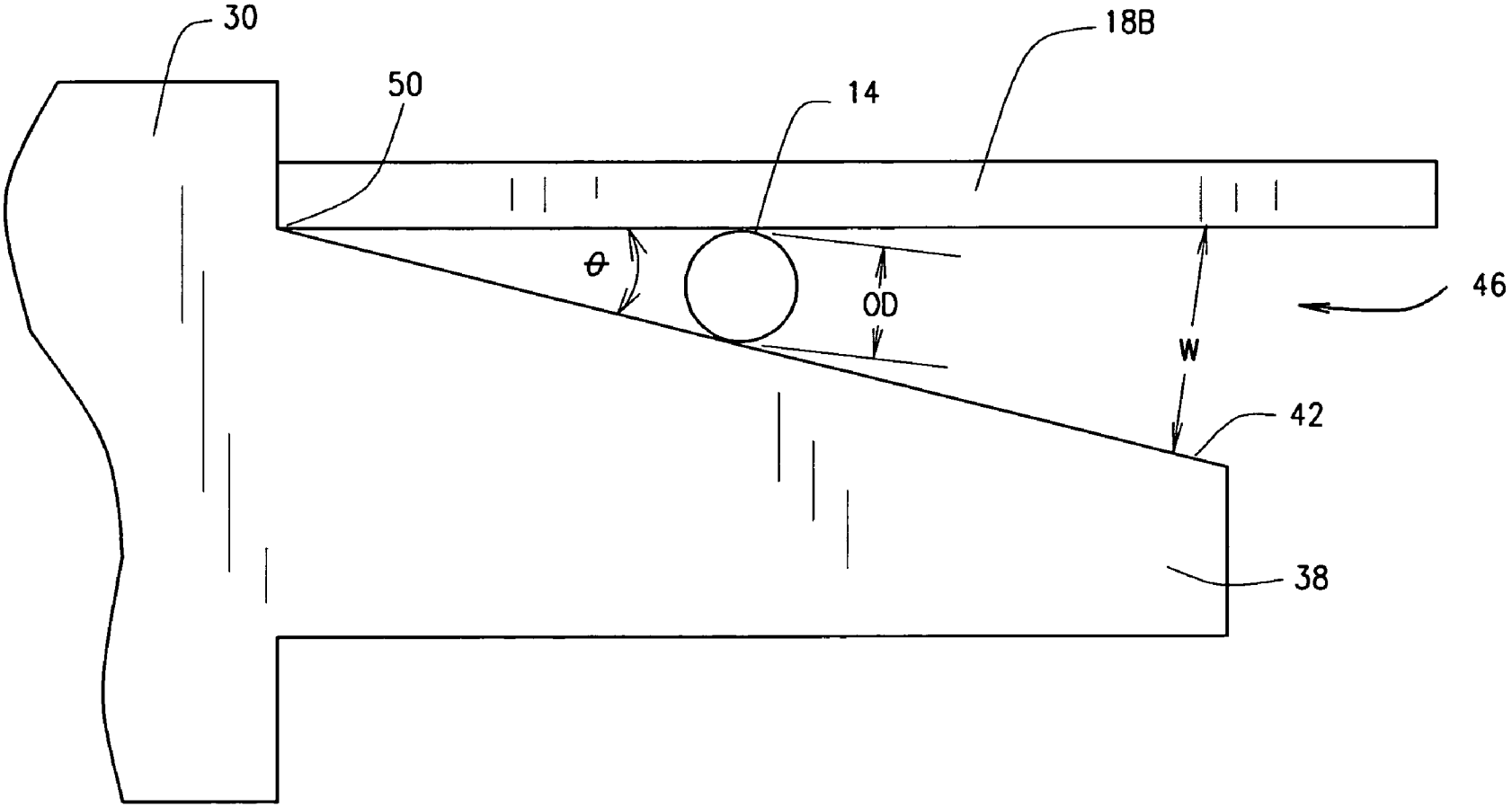
FIG. 4 is a block diagram illustrating an acute angle formed between a pin and a standoff of the exemplary connector shown in FIG. 1, in accordance with various embodiments of the present disclosure.
Figure 5:
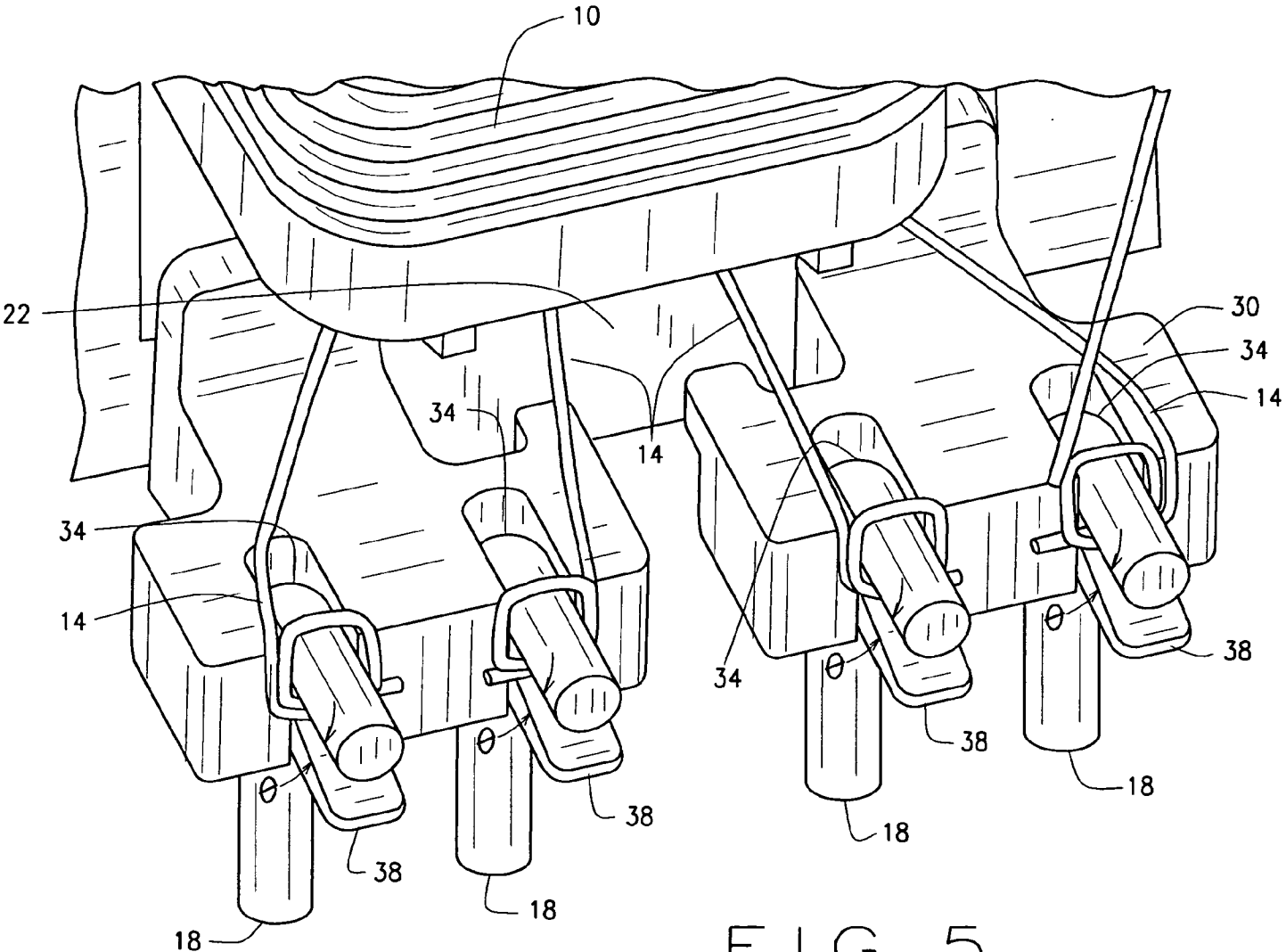
FIG. 5 is an isometric view of an exemplary connector shown in FIG. 1, having a wire of the electrical component wrapped around pins of the connector shown in FIG. 1, in accordance with various other embodiments of the present disclosure.

Referring additionally to FIGS. 4 and 5, in accordance with various embodiments, each standoff 38 includes an interior face 42 that is adjacent to and forms an acute angle θ with the respective pin 18. As illustrated in FIGS. 2, 3, 4 and 5, in various embodiments the second leg 18B extends substantially orthogonally from the connector base 30 and the standoff interior face 42 extends from the connector base 30 at an angle, thereby forming the acute angle θ. The interior face 42 can have various suitable shapes and contours. For example, in various embodiments, the interior face 42 can have a generally flat surface contour, as illustrated in FIG. 2, while in other embodiments, the interior face 42 can have a generally concave contour, as illustrated in FIG. 3. Alternatively, the interior face 42 can have any suitable shape or contour, e.g., convex, and remain within the scope of the present disclosure.

Referring particularly to FIG. 4, each acute angle θ includes an open end 46 and a vertex 50 that originates near the connector base 30. The size of the acute angle θ is selected such that the open end 42 is sized to receive the wire 14. More particularly, the acute angle θ is selected such that the open end 42 is sized to have a width W that is larger than an outside diameter OD of the respective wire 14 that is to be wrapped around the pin second leg 18B. Thus, to terminate a wire 14 on the respective pin 18, the wire 14 can be inserted between the respective pin second leg 18B and standoff 38 at the acute angle open end 42. The wire 14 can then be moved, or pulled, between the second leg 18B and standoff 38 toward the connector base 30 and acute angle vertex 50 until the wire 14 is pinched, or force fit, between the pin second leg 18B and standoff 38 near the vertex 50. The wire 14 can then be wrapped around the pin second leg 18B a single time, or turn, as illustrated in FIG. 5. The wire 14 is thereby firmly held on the pin 18 where solder can subsequently be applied to secure, or affix, the wire 14 the pin 18.

Alternatively, once the wire 14 is pinched between the respective pin second leg 18B and standoff 30, the wire 14 can be wrapped more than a single time, or turn, and remain within the scope of the present disclosure. However, the more turns employed, the greater the amount of wire 14 that will be used, thereby increasing manufacturing costs.

Figure 6A:
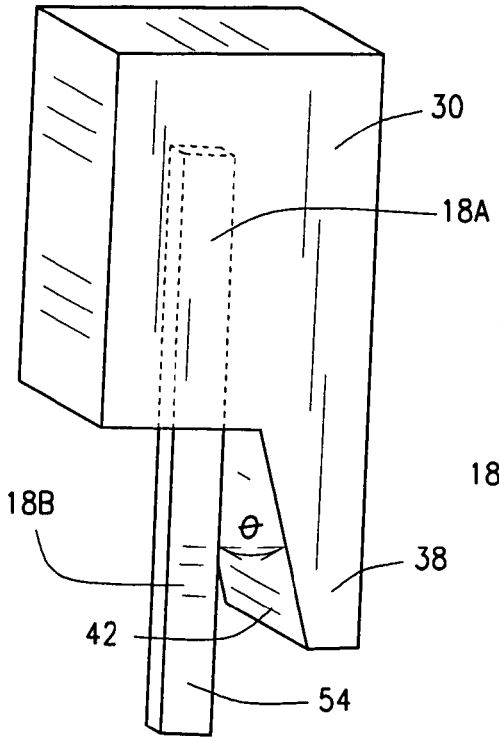
FIG. 6A is an isometric view of a portion of the exemplary connector shown in FIG. 1, including an electrical pin having a substantially straight form, in accordance with various embodiments of the present disclosure.
Figure 6B:
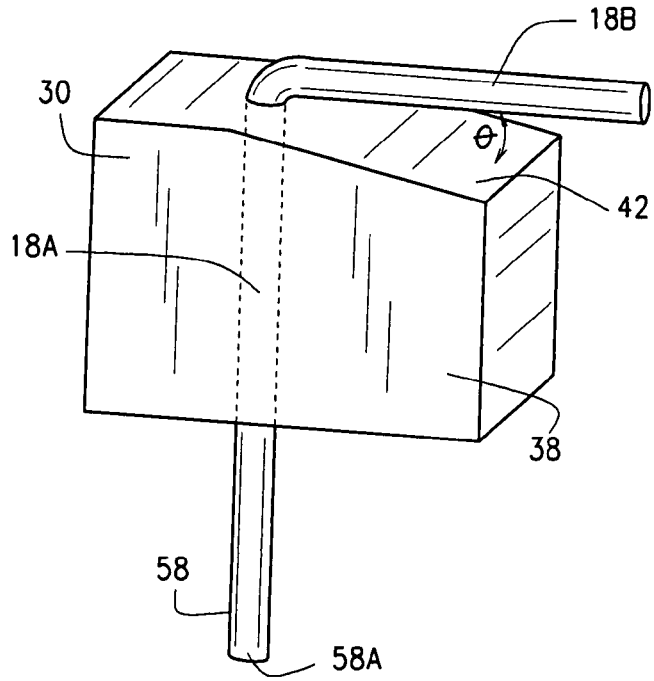
FIG. 6B is an isometric view of a portion of the exemplary connector shown in FIG. 1, including an electrical pin having a substantially 'L' shape, in accordance with various embodiments of the present disclosure.
Figure 6C:
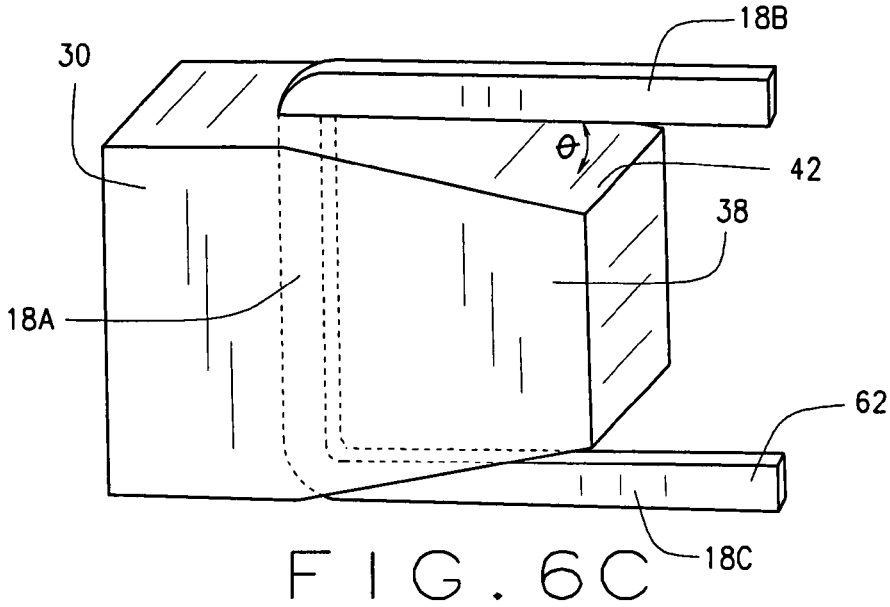
FIG. 6C is an isometric view of a portion of the exemplary connector shown in FIG. 1, including an electrical pin having a substantially 'U' shape, in accordance with various embodiments of the present disclosure.

Referring now to FIGS. 6A, 6B and 6C, as described above, the pins 18 can be connected to the circuit board 26 to mount the respective connectors 22 to the circuit board 26 and provide an electrical connection between the component 10 and circuit board 26. More specifically, the pins 18 can have any shape and form adapted to allow a portion of the respective pin 18, e.g., the first and/or second legs 18A and/or 18B, to be electrically connected to the circuit board 26.

For example, in various embodiments, the pin 18 can have a substantially straight form, as illustrated in FIG. 6A. In such embodiments, the pin first leg 18A is retained within connector base 30 and the second leg 18B extends from the base 30 adjacent the standoff 38 to form the acute angle 0, as described above. Once the wire 14 is pinched between the pin second leg 18B and the standoff 38 and wrapped around the pin second leg 18B, as described above, a distal end portion 54 can be connected to the circuit board 26. More particularly, the distal end portion 54 of the second leg 18B of each straight pin 18 can be inserted into a via (not shown) of the circuit board 26. Solder can then be applied to the distal end portion 54 to affix the respective straight pins 18, connectors 22, and the attached component 10 to the circuit board 26.

In various other embodiments, the pin 18 can have a substantially 'L' shape, as illustrated in FIG. 6B. In such embodiments, the pin first leg 18A is retained within connector base 30 and a distal portion 58 extends, or protrudes, from the connector base 30. The second leg 18B extends from the base 30 substantially orthogonally with pin first leg 18A and adjacent the standoff 38 to form the acute angle θ, as described above. Once the wire 14 is pinched between the pin second leg 18B and the standoff 38 and wrapped around the pin second leg 18B, as described above, an end section 58A of the distal portion 58 can be connected to the circuit board 26. More particularly, the end section 58A of the first leg 18A of each 'L' shaped pin 18 can be inserted into a via (not shown) of the circuit board 26. Solder can then be applied to the end section 58A to affix the respective 'L' shaped pins 18, connectors 22, and the attached component 10 to the circuit board 26.

In still other embodiments, the pin 18 can have a substantially 'U' shape, as illustrated in FIG. 6C. In such embodiments, the pin 18 includes a third leg 18C that extends substantially orthogonally from the first leg 18A. In such embodiments, the pin first leg 18A is retained within connector base 30 and third leg 18C extends, or protrudes, from the connector base 30 substantially orthogonally to the first leg 18A. Similarly, the second leg 18B extends from the base 30 substantially orthogonally with pin first leg 18A and adjacent the standoff 38 to form the acute angle θ, as described above. Once the wire 14 is pinched between the pin second leg 18B and the standoff 38 and wrapped around the pin second leg 18B, as described above, a distal end portion 62 of the third leg 18C can be connected to the circuit board 26. More particularly, the distal end portion 62 of the third leg 18C of each 'U' shaped pin 18 can be inserted into a via (not shown) of the circuit board 26. Solder can then be applied to the distal end portion 62 to affix the respective 'U' shaped pins 18, connectors 22, and the attached component 10 to the circuit board 26.

The pins 18 can have any cross-sectional shape suitable for any particular application. For example, the pins 18 can have a square cross-section, as shown in FIGS. 6A and 6C. Or, the pins 18 can have a round cross-section, as shown in FIGS. 1, 2, 3 and 6A. Alternatively, the pins 18 can have any other suitable cross-sections such as flat, rectangular, triangular, etc. and remain within the scope of the present disclosure.

Figure 7:
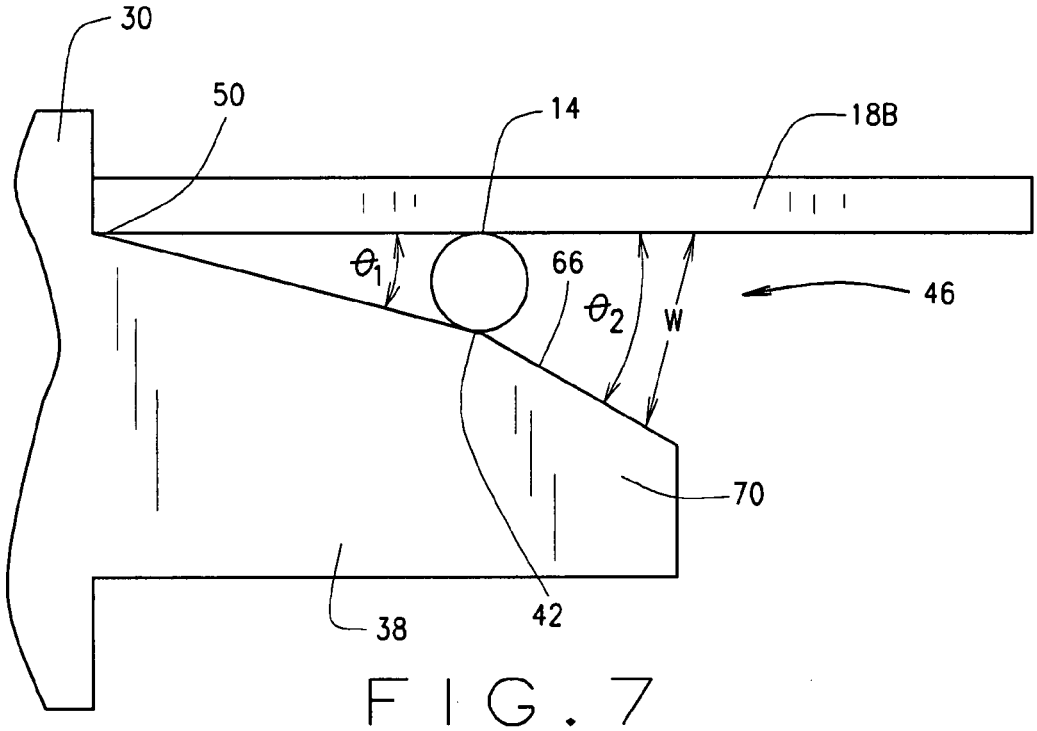
FIG. 7 is a block diagram illustrating a two-part acute angle formed between a pin and a standoff of the exemplary connector shown in FIG. 1, in accordance with various embodiments of the present disclosure.

Referring now to FIG. 7, in various other embodiments, the standoffs 38 can be shaped to form a two-part acute angle between the respective pin 18 and standoff interior face 42. That is, the interior face 42 of the standoff 38 can include a beveled portion 66 at a standoff distal end portion 70 that provides a wider acute angle open end 46. Accordingly, the standoff 38 is shaped to form a first acute angle $\theta_1$ between the pin 18 and the standoff interior face 42 near the vertex, and a second acute angle $\theta_2$ near the open end 46.

Thus, to terminate a wire 14 on the respective pin 18, the wire 14 can be inserted between the respective pin second leg 18B and standoff 38 at the open end 42 whose width W corresponds to the second acute angle $\theta_2$. The wire 14 can then be moved, or pulled, between the second leg 18B and standoff 38 toward the connector base 30 and the vertex 50 of the first acute angle $\theta_1$ until the wire 14 is pinched, or force fit, between the pin second leg 18B and standoff 38 near the vertex 50. The wire 14 can then be wrapped around the pin second leg 18B one or more times, or turns and solder can subsequently be applied to secure, or affix, the wire 14 to the pin 18, as described above. The second acute angle $\theta_2$ can allow space for a winding machine (not shown) to wrap and terminate the respective wire 14 around the pin second leg 18A.

Figure 8:
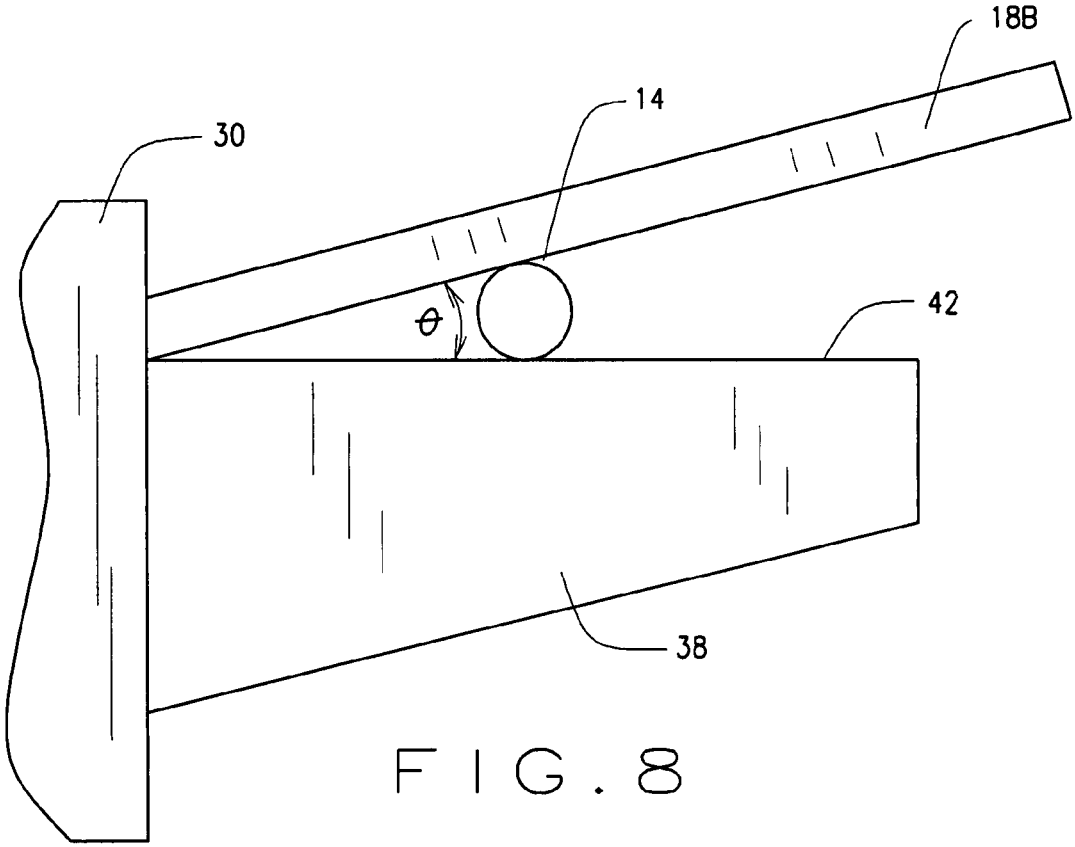
FIG. 8 is a block diagram illustrating an acute angle formed between a pin and a standoff of the exemplary connector shown in FIG. 1, in accordance with various other embodiments of the present disclosure.

Referring now to FIG. 8, in various embodiments the standoff 38 can be formed such that the interior face 42 extends substantially orthogonally from the connector base 30. Conversely, the pin second leg 18B extends from the connector base at an angle to thereby form the acute angle $\theta$. The wire 14 can then be pinched between the pin second leg 18B and the standoff 38 in the same manner as described above.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. An electrical connector comprising an electrically conductive pin configured to electrically connect with a circuit board and extending from a base of the connector, and a standoff extending from the base of the connector adjacent the pin and forming an acute angle with the pin, wherein the pin has a substantially 'L' shape including a first leg retained in the connector base and having a distal portion extending from the connector, and a second leg extending adjacent the standoff substantially orthogonally from the first leg and forming the acute angle, the distal portion of the first leg configured to electrically connect with the circuit board.

2. An electrical connector comprising an electrically conductive pin configured to electrically connect with a circuit board and extending from a base of the connector, and a standoff extending from the base of the connector adjacent the pin and forming an acute angle with the pin, wherein the pin has a substantially 'U' shape having a first leg retained in the connector base, a second leg extending adjacent the standoff substantially orthogonally from the first leg and forming the acute angle, and a third leg extending from the connector substantially orthogonally from the first leg and configured to electrically connect to the circuit board.

3. An electrical connector comprising a base configured to retain a first leg of an electrically conductive pin such that a second leg of the pin extends from the base, the base including a standoff extending from the base adjacent the second leg and forming an acute angle with the second leg, the acute angle sized to receive a wire at an open end of the acute angle, and pinch and retain the wire between the pin second leg and the standoff near a vertex of the acute angle that originates near the connector base.

4. The connector of claim 3, wherein the pin is formed to have a substantially 'U' shape and including a third leg, the second leg extending adjacent the standoff substantially orthogonally from a first end of the first leg, the third leg extending from the connector base substantially orthogonally from a second end of the first leg and configured to electrically connect to the circuit board.

5. The connector of claim 3, wherein the pin second leg extends substantially orthogonally from the connector base and an interior surface of the standoff extends from the connector base at an angle to form the acute angle between the pin second leg and the standoff.

6. The connector of claim 3, wherein an interior surface of the standoff extends substantially orthogonally from the connector base and the pin second leg extends from the connector base at an angle to form the acute angle between the pin second leg and the standoff.

7. The connector of claim 3, wherein the standoff is shaped to form a first acute angle between the pin second leg and the standoff near the connector base and a second acute angle between the pin second leg and the standoff at a distal end portion of the standoff.

8. The connector of claim 3 wherein the standoff includes an interior face having a generally flat surface contour.

9. The connector of claim 3 wherein the standoff includes an interior face having a generally concave contour.

10. The connector of claim 3, wherein the pin is configured to electrically connect with a circuit board.

11. The connector of claim 10, wherein the pin is formed to have a substantially straight form such that a distal end of the second leg, at an open end of the acute angle, is configured to electrically connect with the circuit board.

12. The connector of claim 10, wherein the pin is formed to have a substantially 'L' shape, a distal portion of the first leg extending from the connector base and the second leg extending adjacent the standoff substantially orthogonally from the first leg, the distal portion of the first leg configured to electrically connect with the circuit board.

13. The connector of claim 3, further comprising a wire pinched and retained between the pin second leg and the standoff near the vertex of the acute angle that originates near the connector base.

14. The connector of claim 13, wherein the wire is wrapped around the pin at least a single time.

15. The connector of claim 14, wherein the wire is soldered to the pin.

16. The connector of claim 15, wherein the wire is wrapped around the pin only a single time.

17. The connector of claim 15, wherein the wire extends from a transformer.

18. The connector of claim 17, wherein the pin is electrically connected to a circuit board.

19. The connector of claim 18, wherein the wire is wrapped around the pin only a single time.

20. A method for securing a wire of an electrical component to an electrical connector connectable to a circuit board to provide electrical connection between the wire and the circuit board, the electrical connector including a base configured to retain a first leg of an electrically conductive pin such that a second leg of the pin extends from the base, the base including a standoff extending from the base adjacent the second leg and forming an acute angle with the second leg, said method comprising:

inserting a wire into an open end of the acute angle formed between the pin second leg and the standoff, the acute angle having a vertex near the base;

pushing the wire toward the vertex of the acute angle; and pinching the wire between the pin second leg and the standoff near a vertex of the acute angle to secure the wire to the connector.

21. The method of claim 20 further comprising wrapping the wire around the pin at least a single time after the wire is pinched between the pin and the standoff.

22. The method of claim 20 further comprising applying solder to the pin and wire to bond the wire to the pin.

23. The method of claim 20, wherein the electrical component comprises a transformer.

24. The method of claim 20, wherein the pin is formed to have one of:

a substantially straight form such that a distal end of the pin, at the open end of the acute angle, is configured to electrically connect with the circuit board.

a substantially 'L' shape including a first leg retained in the connector base and having a distal portion extending from the connector, and a second leg extending adjacent the standoff substantially orthogonally from the first leg and forming the acute angle, the distal portion of the first leg configured to electrically connect with the circuit board; and a substantially 'U' shape having a first leg retained in the connector base, a second leg extending adjacent the standoff substantially orthogonally from the first leg and forming the acute angle, and a third leg extending from the connector substantially orthogonally from the first leg and configured to electrically connect to the circuit board.

25. The method of claim 21 wherein wrapping including wrapping the wire around the pin only a single time after the wire is pinched between the pin and the standoff.

26. A method for securing a wire to an electrical connector, the electrical connector including at least one electrically conductive pin and a standoff extending adjacent the pin and forming an acute angle with at least a portion of the pin, the method comprising:

inserting a wire into an open end of the acute angle formed between the pin and the standoff;

pinching the wire between the pin and the standoff near a vertex of the acute angle;

wrapping the pinched wire around the pin only a single time; and soldering the wrapped wire to the pin.

27. The method of claim 26, wherein the wire extends from a transformer.

28. The method of claim 27, further comprising electrically connecting the pin to a circuit board to provide electrical connection between the transformer wire and the circuit board.

* * * * *